United States Patent [19]

Ishikawa

[11] 3,943,583

[45] Mar. 16, 1976

[54] BED WITH A COMMODE

[75] Inventor: Yoshitaka Ishikawa, Matsuyama, Japan

[73] Assignee: Daika Kabushiki-Kaisha, Matsuyama, Japan

[22] Filed: Nov. 26, 1974

[21] Appl. No.: 527,279

[30] Foreign Application Priority Data

May 28, 1974 Japan ..... 49-59983

[52] U.S. Cl. ..... 5/90; 4/110; 5/91

[51] Int. Cl.[2] ..... A61G 07/02

[58] Field of Search ..... 5/90, 91; 128/33; 4/110, 4/112

[56] References Cited

UNITED STATES PATENTS

| | | | |
|---|---|---|---|
| 2,500,743 | 3/1950 | Beem et al. | 5/90 |
| 3,345,652 | 10/1967 | Hiraga | 5/90 |
| 3,503,083 | 3/1970 | Barnett | 5/90 |
| 3,667,075 | 6/1972 | Ballard | 5/91 |
| 3,757,355 | 9/1973 | Allen et al. | 5/90 |

*Primary Examiner*—Casmir A. Nunberg

*Attorney, Agent, or Firm*—Browdy and Neimark

[57] ABSTRACT

A bed provided with a commode or stool has a main mattress provided with a through-hole into which the commode or an auxiliary mattress may be positioned alternately by manipulation of an operating panel mounted at or near the bed. The front part of the main mattress may be erected along a transverse fold line so as to serve as reclining portion.

9 Claims, 4 Drawing Figures

BED WITH A COMMODE

This invention relates to an improved bed with a built-in commode or stool, wherein the commode or stool can be brought from its housed position to its use position by simple manipulation of an operating panel provided at or near the bed.

The bed with built-in commode or stool in accordance with the present invention comprises a bed frame having a housing section at its lower portion, a main mattress provided with a through-hole at a location corresponding with the thighs of a user lying on the bed, said through-hole communicating with the interior of said housing section, an auxiliary mattress being sized to fit into said through-hole, a driving device for elevating said auxiliary mattress into registration with said through-hole and lowering said auxiliary mattress, a commode being also sized to fit into said through-hole and normally disposed within the interior of said housing section, and a further driving device for elevating said commode into registration with said through-hole and again lowering said commode to its housed position, wherein said driving devices for said auxiliary mattress and the commode are opratively linked with each other by the intermediary of a separate operating panel in such a manner that said auxiliary mattress and the commode may be alternately brough into the position registered with the through-hole.

The driving devices for the auxiliary mattress and the commode may be driven pneumatically, hydraulically, mechanically or electrically as the occasion may demand.

In the drawing

FIG. 3 and 4 are the detailed views for illustrating the switching function of the bed of FIG. 1, wherein FIG. 3 shows the bed being in one switched state and FIG. 4 shows the bed in the other switched state.

Figure 1:
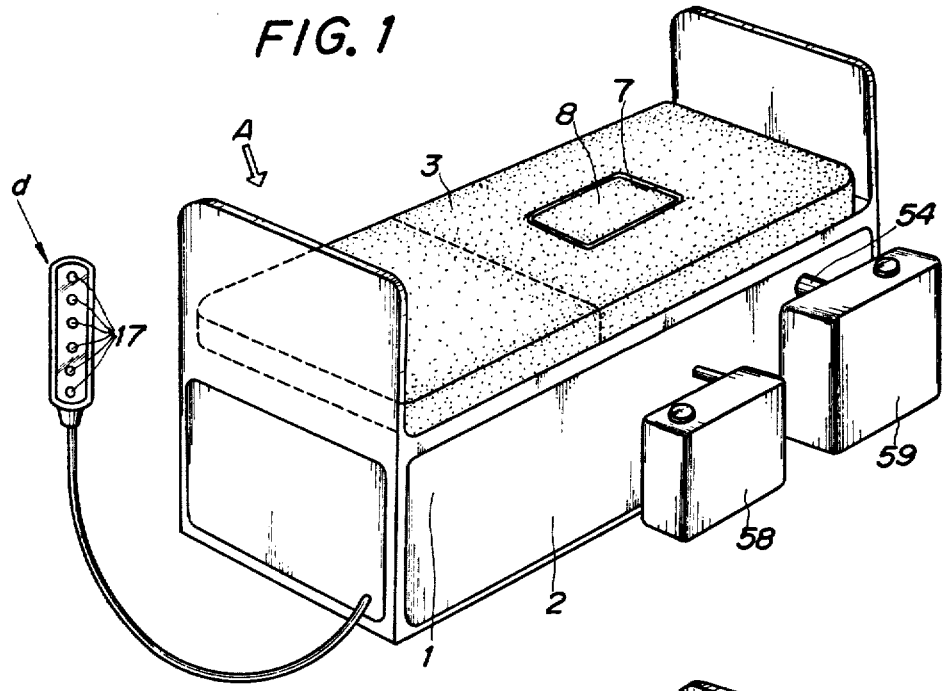
FIG. 1 is a perspective view of the bed being used as an ordinary bed with the auxiliary mattress received in the through-hole of the main mattress.
Figure 2:
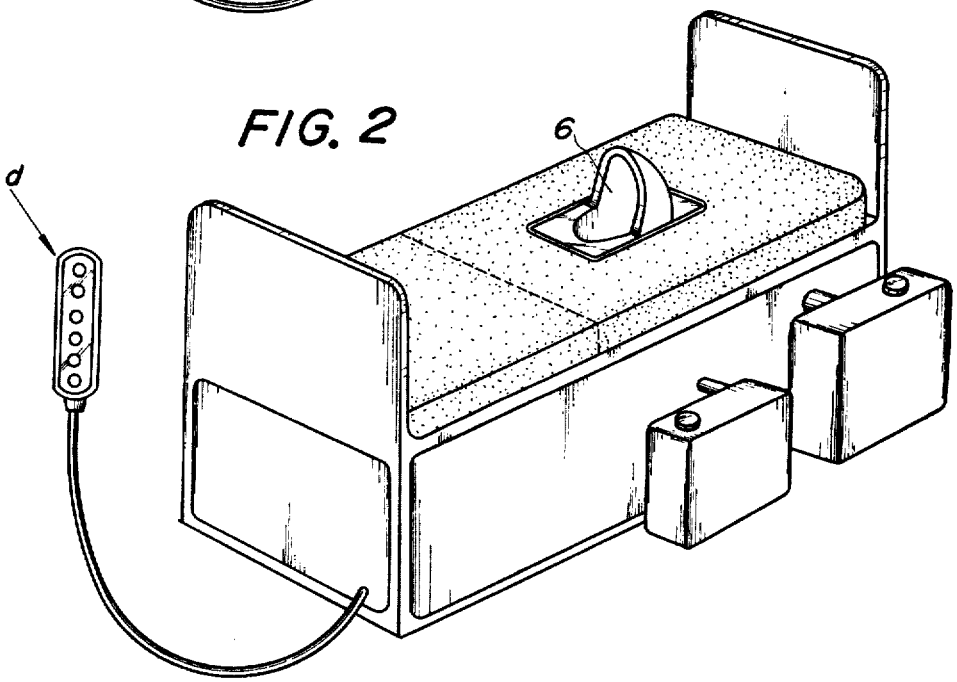
FIG. 2 is an overall perspective view of the same, with the commode received in the through-hole of the main mattress.

Referring now to FIG. 1 showing the overall structure of the inventive bed A fitted with a commode, the numeral 1 designates a bed frame with its lower part accommodated in a housing section 2, and numeral 3 a mattress placed on the upper surface of the bed frame 1.

Figure 4:
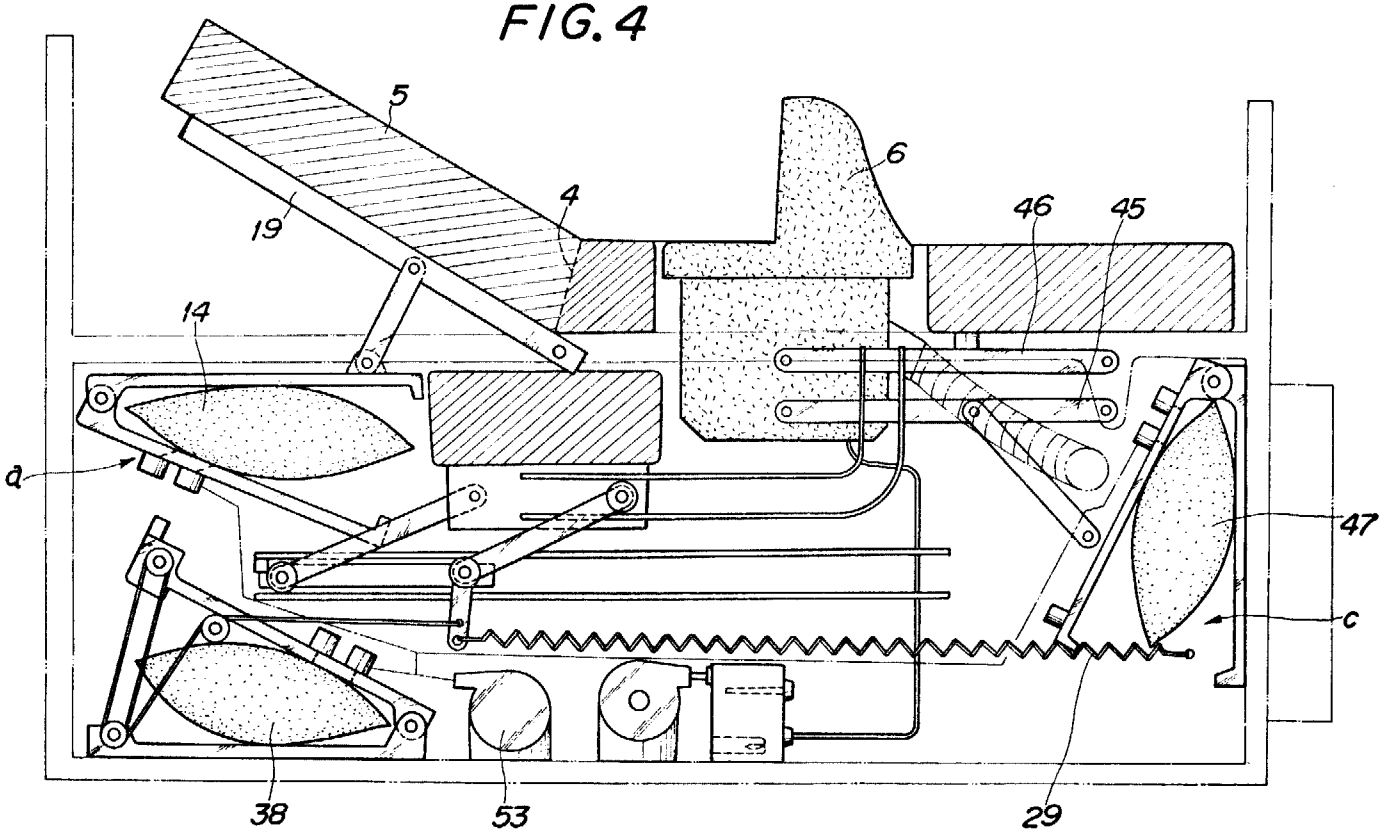

Said mattress 3 is designed so that its front half portion may be erected along a fold line as shown in FIG. 4 so as to serve as a recline for the back of a user lying on the mattress 3. The rear half portion of the mattress 3 has a through-hole 7 at a position corresponding with the thighs of the user, said through-hole 7 communicating with the interior of the housing section 2.

Figure 3:
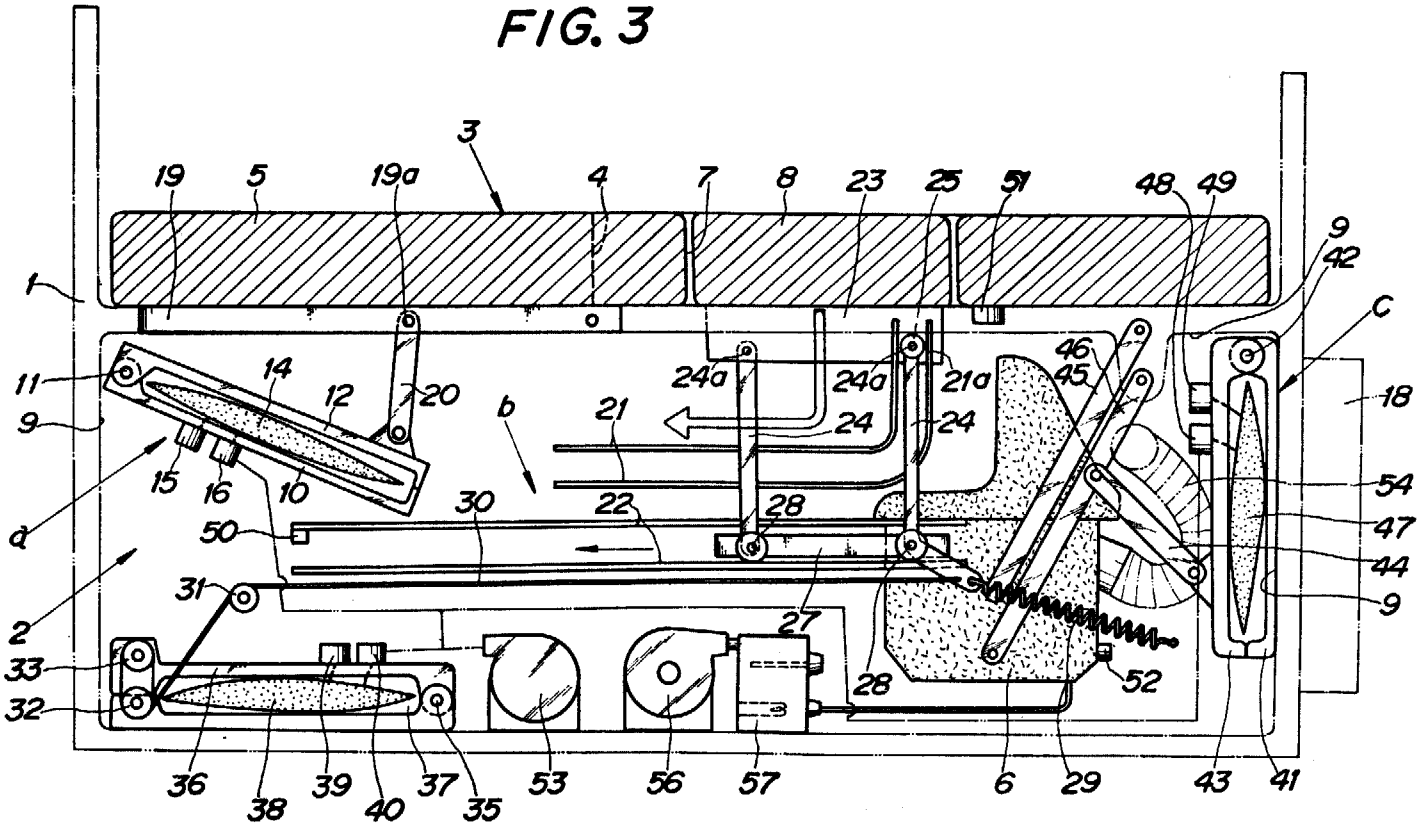

The numeral 8 designates an auxiliary mattress that is movable freely relative to said through-hole 7 and supported, as shown in FIG. 1, normally in said through-hole 7 by means of a driving device *b*. Numeral 6 indicates a commode being sized to fit into said through-hole 7 and housed usually within the interior of said housing section 2. Said commode 6 is designed to be elevated to a position inside said through-hole 7 by operation of a further driving device *c*, as shown in FIG. 3. A still further driving device *a* for actuating the reclining portion 5 comprises a fixed plate 10 secured obliquely to the wall 9 of the bed frame 1, a movable plate 12 pivotally mounted by a pivot 11 provided to the forward end of the fixed plate 10, an inflatable air pouch 14 interposed between the plates 10 and 12 and provided with an air supply port and an air discharge port, not shown, a blower 53 communicating with the air supply port of the pouch 14 and mounted separately within the interior of the housing section 2, a magnetic valve 16 annexed to said supply port for controlling the communication between said supply port and the blower 53, and a further magnetic valve 15 annexed to said discharge port for controlling its opening and closure.

These magnetic valves 15,16 are connected to an operating panel *d* through an adjustment unit 18 so as to be operated by the selected one of switches 17 of the panel *d*. A pair of support arms 19 are provided to both side edges of the bed frame 1 by a transverse shaft 19*a* disposed forwardly of the fold line 4, although only one of these arms 19 is shown in FIG. 3. These support arms 19 are connected by a pair of levers 20 to the side edges of the movable plate 12 so that said reclining portion 5 may be erected or leveled by inflating or deflating said air pouch 14 upon manipulation of the operating panel *d*.

The driving device *b* for the auxiliary mattress 8 comprises a pair of upper rails 21 adapted for guiding the auxiliary mattress 8 downwardly and then forwardly, and mounted in the interior of the bed frame 1, a pair of lower rails 22 mounted equally in the interior of the bed frame 1, a support plate 23 for the auxiliary mattress, two pairs of front and rear side levers 24, 24 depending from pivot shafts 24*a*, 24*a* provided to said support plate 23, a pair of trucks 27 movable back and forth along said each lower rail 22 and having axles 28, 28 carrying the lower ends of said side levers 24, 24, guide wheels 25 provided to the rear side levers 24 and resting on the upper right-hand end of the upper rail 21, and a rope 30 connected at one end to an extension of one of said rear side levers 24 for pulling each truck against the force of a return spring 29, the one end of which is secured fixedly to the wall 9 of the bed frame. Said rope 30 is tensioned along the lower rails 22 through an intermediate pulley 31 and placed around a pair of leading blocks 32, 33. The leading block 32 is journaled by a fixed plate 34, while the block 33 is journaled by a movable plate 36 pivotally mounted by a pivot shaft 35 provided to said fixed plate 34. An air pouch 38 provided with an air supply port and an air discharge port is interposed within a gap 37 defined by and between said fixed and movable plates 34, 36. The supply port of the air pouch 38 communicating with the blower 53 is provided with a magnetic valve 40 adapted to control the communication between the ssupply port and the blower 53. The said magnetic valve 40 is wired with the operating panel *d* by way of the adjustment unit 18 so as to by opened by selected one of the switches 17 of the panel *d* and closed by a limit switch 50. Also, a magnetic valve 39 is provided to the discharge port of the pouch 38 so as to be opened by a second limit switch 52.

The actuating device *c* for the commode 6 comprises a fixed plate 41 secured to the wall 9, a movable plate 43 pivotally mounted with pivot shaft 42 to said fixed plate 41, a pair of side levers 44 pivoted at one of ends to said movable plate 43, and two pairs of link plates 45, 46. The other ends of the side levers 44 are mounted pivotably to the rear pair of the link levers 46 so as to be switched between a position is which the commode 6 is engaged in the through-hole 7 and a position in which the commode 6 is contained within the housing section 2. An air pouch 47 provided with an air supply port and an air discharge port is interposed within a gap defined by and between said fixed and movable plates 41, 43 and is adapted for communication with the air blower 53. A magnetic valve 48 is mounted at said air supply port for controlling the communication between the air supply port and the air blower 58 and wired by way of the adjustment unit 18 so as to be opened by the first limit switch 50 and closed by a second limit switch 51. The air discharge port of the air pouch 47 is provided with a further magnetic valve 49 which may be opened by operation at the operating panel *d*. The numeral 56 designates a water pump communicating with the commode 6 by way of a warming tank 57 for flushing the soil from inside of the commode 6. The flush water may be supplied from the water supply pipe of a water tank 58 mounted laterally of the bed frame 1. The flushed soil may be discharged by way of a hose into a tank 59 also provided laterally of the bed frame, or directly into a sewage or into an aerated tank for biological treatment.

The operation of the inventive bed with a commode is as follows.

First, the air blower 53 and the magnetic valve 40 provided to the supply port of the air pouch 38 are supplied with electric current by closing selected one of the switches 17 of the operating panel *d*, thereby starting the operation of the air blower 53 and opening the magnetic valve 40. The air pouch 38 is now filled with air and inflated so that the movable plate 36 is pivoted with the shaft 35 as center. The truck 27 is now pulled by the rope 30 in the direction of the arrow, against the force of the spring 29. The guide wheels 25 fitted to the upper ends of the rear side levers 24 are lowered along the upright portion of the rail 21 and then shifted along the horizontal portion, so that the mattress 8 is moved to its housed position shown in FIG. 4. The magnetic valve 40 is closed by operation of the first limit switch 50 mounted at the front end of the rail 22 at the same time that the magnetic valve 48 associated with the commode 6 is opened for filling the air pouch 49 with air. Thus the levers 44 are pivoted clockwise together with the movable plate 43 so that the commode 6 is moved by the link plates 45, 46 from its housed position to a position of registration with the through-hole 7. At this time, the magnetic valve 48 is closed by operation of the limit switch 48, and the commode 6 is fixed positively in the position of usage as shown in FIG. 4.

After usage, the selected one of the switches 17 at the operating panel *d* is depressed for opening the magnetic valve 49 and discharging the air from the air pouch 47. The commode 6 is now returned by its gravity into its housed position, as shown in FIG. 3, at the same time that the magnetic valve 39 associated with the auxiliary mattress 8 is opened by operation of the second limit switch 52 so as to discharge the air from the interior of the air pouch 38 and release the movable plate 36. The return spring 29 now acts for returning the truck 27 towards right in the drawing and the auxiliary mattress 8 is pulled along the upper rail 21 so as to close the through-opening 7 provided in the main mattress 3.

The reclining portion 5 of the main mattress 3 can be moved to its erected position of FIG. 4 by operating the selected one of the switches 17 for opening the magnetic valve 16 and supplying the air from the air blower 53 into the air pouch 14. As the pouch 14 is inflated with air, the movable plate 12 is swung clockwise about pivot shaft 11, together with the levers 20, the arms 19 being swung clockwise about the pivot shaft 18 together with the reclining portion 5 of the main mattress 3 resting on the arms 19. As the selected one of the switches 17 is manipulated, the magnetic valve 15 associated with the discharge port is opened for discharging the air from the air pouch 14 so as to release the reclining portion 5, which may now be lowered by its gravity to its horizontal position.

According to the present invention, the commode can be elevated by manipulation of the operating panel *d* from its housed position to its use position and lowered again to its housed position, thus making the attendance of the nurse or other tending personnel unnecessary. When the commode is out of use, the auxiliary mattress is positioned by manipulation of the operating panel in alignment with the main mattress for usage as an ordinary bed.

What is claimed is:

1. A bed for invalids or other persons comprising:

a bed frame;

a main mattress covering said bed frame, said main mattress provided with a through-hole at a location corresponding with the thighs of a person lying on the bed, said through-hole communicating with the interior of said housing portion;

a housing portion disposed entirely below said main mattress;

an auxiliary mattress sized to fit into said through-hole;

first driving means contained in said housing portion and connected to said auxiliary mattress for movably supporting said auxiliary mattress at a working position registered with said through-hole and for transporting said auxiliary mattress from said working position to a resting position completely within said housing and from said resting position to said working position;

a commode normally disposed within said housing position and sized to fit into said through-hole;

second driving means contained in said housing position for transporting said commode from a resting position completely within said housing to a working position in said through-hole and from said working position to said resting position; and control means operatively connected to said first and second driving means for alternately transporting said auxiliary mattress and said commode into a position registered with said through-hole, said control means allowing only one of said first and second driving means to be actuated at one time.

2. A bed as claimed in claim 1, in which said first and second driving means always moveably support said auxiliary mattress and said commode horizontally.

3. A bed according to claim 1, wherein a portion of said main mattress is tiltable.

4. A bed according to claim 3, further comprising third driving means for tilting said portion of said main mattress.

5. A bed according to claim 1, wherein each of said first and second driving means comprise:

a fixed plate;

a movable plate pivotally mounted to one end of said fixed plate;

an inflatable bag disposed between said fixed plate and said movable plate, said inflatable bag having an air input and air discharge port; and a blower mounted in said housing portion communicating with said air input port.

6. A bed according to claim 1, wherein said control means includes an operating panel from which said first and second driving means is operated.

7. A bed according to claim 1, further comprising a water tank mounted on said housing portion for flushing soiled material from said commode.

8. A bed according to claim 6, wherein said control means further comprises:

first magnetic valve means attached to said first driving means and electrically connected to said operating panel for activating said first driving means;

second magnetic valve means attached to said second driving means and electrically connected to said operating panel for activating said second drive means;

first limit switch attached to said first driving means;

second limit switch attached to said commode;

third magnetic valve means attached to said first driving means and electrically connected to said second limit switch for activating said first driving means; and fourth magnetic valve means attached to said second driving means and electrically connected to said first limit switch for activating said second driving means.

9. A bed according to claim 3, further comprising an operating panel for operating said first, second and third driving means.

* * * * *

UNITED STATES PATENT AND TRADEMARK OFFICE

CERTIFICATE OF CORRECTION

PATENT NO. : 3,943,583
DATED : March 16, 1976
INVENTOR(S) : Ishikawa

It is certified that error appears in the above-identified patent and that said Letters Patent are hereby corrected as shown below:

--[73] Assignee: Daiki Kabushiki-Kaisha-- column 1, line 28, delete "brough" and insert --brought--

Signed and Sealed this
Tenth Day of August 1976

[SEAL]

*Attest:*

RUTH C. MASON
*Attesting Officer*

C. MARSHALL DANN
*Commissioner of Patents and Trademarks*